US009796076B2

(12) United States Patent
Baruch

(10) Patent No.: US 9,796,076 B2
(45) Date of Patent: Oct. 24, 2017

(54) TOOL ORGANIZER WITH LOCKING LINKAGE MECHANISM

(71) Applicant: The Stanley Works Israel Ltd., Rosh Ha'Ayin (IL)

(72) Inventor: Danny Baruch, Lapid (IL)

(73) Assignee: THE STANLEY WORKS ISRAEL LTD (IL)

( * ) Notice: Subject to any disclaimer, the term of this patent is extended or adjusted under 35 U.S.C. 154(b) by 0 days.

(21) Appl. No.: 15/249,779

(22) Filed: Aug. 29, 2016

(65) Prior Publication Data

US 2017/0066124 A1 Mar. 9, 2017

(30) Foreign Application Priority Data

Sep. 4, 2015 (EP) ..... 15183959

(51) Int. Cl.

| | |
|---|---|
| ***B25H 3/02*** | (2006.01) |
| ***B65D 25/28*** | (2006.01) |
| ***B65D 43/02*** | (2006.01) |
| ***B65D 43/16*** | (2006.01) |

(52) U.S. Cl.

CPC ..... *B25H 3/023* (2013.01); *B65D 25/2841* (2013.01); *B65D 43/02* (2013.01); *B65D 43/16* (2013.01)

(58) Field of Classification Search

CPC .. B25H 1/12; B25H 3/023; A45C 9/00; A45C 11/003; A45C 11/24; A45C 13/02; A45C 2013/025; B65D 43/163; B65D 43/24; Y10T 292/0911; Y10T 292/0932; Y10T 292/0934; Y10T 292/0948–292/0949; Y10T 292/0951–292/0952; Y10T 292/0959; Y10T 292/1059; Y10T 292/1061; Y10T 292/108; Y10T 292/1083; Y10T 292/1084; Y10T 292/1092; E05B 65/52;

(Continued)

(56) References Cited

U.S. PATENT DOCUMENTS 1,030,758 A * 6/1912 Adler ..... B65D 5/5266 206/742
1,118,326 A * 11/1914 Braen ..... G09F 5/02 190/17

(Continued)

FOREIGN PATENT DOCUMENTS

WO WO 2008090546 A1 * 7/2008 ..... B25H 3/027
WO WO 2014102783 A1 * 7/2014 ..... B25H 3/023

*Primary Examiner* — J. Gregory Pickett
*Assistant Examiner* — Brijesh V. Patel
(74) *Attorney, Agent, or Firm* — Carl E. Myers

(57) ABSTRACT

The invention provides a container comprising an upper section for storage, a lower section for storage, and a linkage arrangement attaching the upper section to the lower section, such that the upper and lower sections can be moved relative to each other between a closed configuration and an expanded configuration, the container further comprising at least one latch having a closed position and a released position, the latch being arranged to retain the upper section and the lower section in the closed configuration when it is in the closed position, and the latch being arranged to be releasable to the released position in which the upper and lower sections are movable into the expanded configuration.

6 Claims, 6 Drawing Sheets

(58) Field of Classification Search
CPC ..... E05B 65/5207; E05B 65/5246; E05B 65/5253; E05C 3/12; E05C 3/14; E05C 3/145
USPC ..... 206/315.11, 349.372–373; 190/17, 30, 190/33–34; D3/273–274, 276, 281, 284, D3/295, 905; 312/201, 235.1, 244, 266, 312/269, 286, 328, 351.5, 902; 292/95–96, 100, 121, 126, 194–195, 200, 292/219, 226, DIG. 38
See application file for complete search history.

(56) References Cited

U.S. PATENT DOCUMENTS

| | | | | | |
|---|---|---|---|---|---|
| 4,743,038 | A * | 5/1988 | Myers | A45C 5/00 | 190/18 A |
| 5,583,612 | A * | 12/1996 | Schell | E05C 3/14 | 292/80 |
| 5,882,097 | A * | 3/1999 | Kohagen | B25H 3/023 | 206/372 |
| D610,351 | S * | 2/2010 | Brunner | D3/273 | |
| 7,743,935 | B2 * | 6/2010 | Maid | A47G 29/20 | 220/210 |
| D618,911 | S * | 7/2010 | Brunner | D3/281 | |
| D703,437 | S * | 4/2014 | Bar-Erez | D3/282 | |
| D728,934 | S * | 5/2015 | Brunner | D3/281 | |
| 2010/0052276 | A1 * | 3/2010 | Brunner | B25H 3/027 | 280/47.35 |
| 2011/0084078 | A1 * | 4/2011 | Twig | B25H 3/023 | 220/507 |
| 2012/0152944 | A1 * | 6/2012 | Vilkomirski | B25H 3/022 | 220/4.28 |

* cited by examiner

TOOL ORGANIZER WITH LOCKING LINKAGE MECHANISM

CROSS-REFERENCE TO RELATED APPLICATIONS

This application claims priority, under 35 U.S.C. §119, to EP Patent Application No. 15183959.4 filed on Sep. 4, 2015, titled "Tool Organiser."

FIELD OF THE INVENTION

The present invention relates to a container which may be utilized as a toolbox or tool organizer for storing items such as hand tools, power tools, tool accessories and screws or the like. The person skilled in the art will appreciate that the container of the present invention may alternatively be used to store other items of a variety of natures.

BRIEF SUMMARY OF THE INVENTION

Containers with handles to allow carrying and which are subdivided into sections are known. However, there is a constant need in the industry to improve upon existing containers by making them more efficient and/or adaptable to different uses. EP2308655 discloses a container which may be used as a tool organizer, the container being divided into a top section and a base section, each comprising a number of sub-compartments. The top section of the container is attached to a base section by a hinge along one edge, such that the top section of the container can be opened to allow access to the sub-compartments. The sub-compartments of the top section require individual covers in order to retain items in the sub-compartments when the top section is being rotated around the hinge to the closed position. A different type of arrangement is disclosed in EP1859908, in which a container is divided into a number of sections, and the sections are attached to each other in a cantilever arrangement, such that the sections remain horizontal during opening and closing.

The aim of the present invention is to provide an improved container arrangement suitable for efficient and ergonomic storage of tools, tool accessories and related items.

The present invention provides a container comprising an upper section for storage, a lower section for storage, and a linkage arrangement attaching the upper section to the lower section, such that the upper and lower sections can be, moved relative to each other between a closed configuration and an expanded configuration. The container further comprises at least one latch having a closed position and a released position, the latch being arranged to retain, the upper section and the lower section in the closed configuration when it is in the closed position, and the latch being arranged to be releasable to the released position in which the upper and lower sections are movable into the expanded configuration, wherein the latch is movable from the closed position into the released position by applying force in substantially the same direction as that required to move the upper and lower sections from the closed configuration into the expanded configuration.

The latch, may be biased to retain the upper section and the lower section in the closed configuration and moving the latch against its bias may allow the upper and lower section to be moved into the expanded configuration. The container may comprises two similar latches, located on opposite side faces of the container.

The latch or latches may each be rotatably attached at a pivot point to the respective opposite side face, and such pivot point may preferably be located on the upper section. The linkage arrangement may comprise at least two struts on each of two opposing sidefaces of the container, each strut being pivotally connected to the upper section at an upper connection point, and each strut being pivotally connected to the lower section at a lower connection point. Furthermore, the pivot point of each latch may be coaxial with the upper connection point of one of the struts on the respective opposite side face of the container.

The upper section may have a removable lid or alternatively the upper section may have a hinged lid. At least one of the upper section and the lower section of the container may be divided into sub-compartments.

BRIEF DESCRIPTION OF THE DRAWINGS

The invention is herein described, by way of example only, with reference to the accompanying drawings, wherein.

DETAILED DESCRIPTION OF THE DRAWINGS

Figure 1:
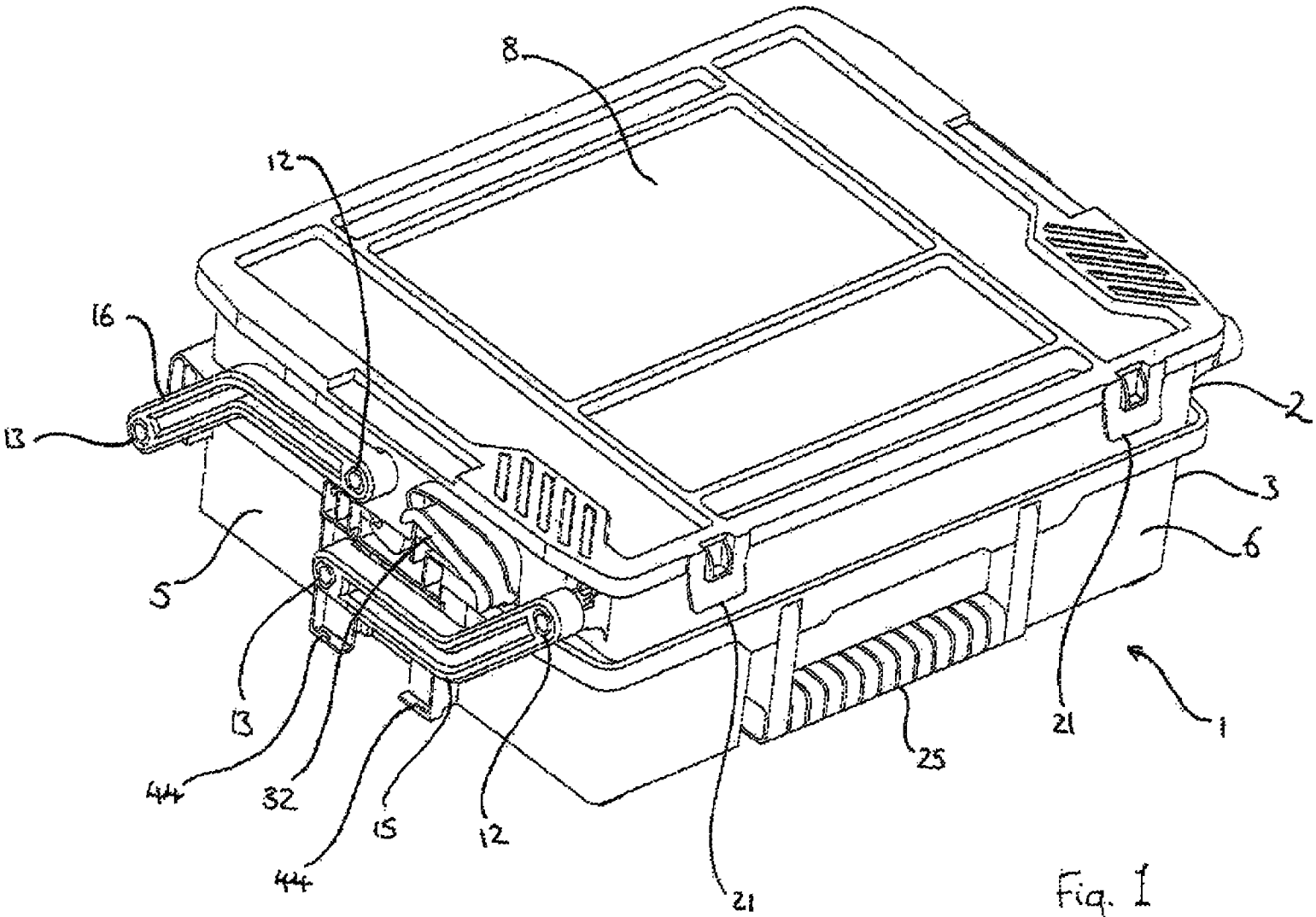
FIG. 1 is a perspective view of a container according to the present invention, in a closed configuration.
Figure 2:
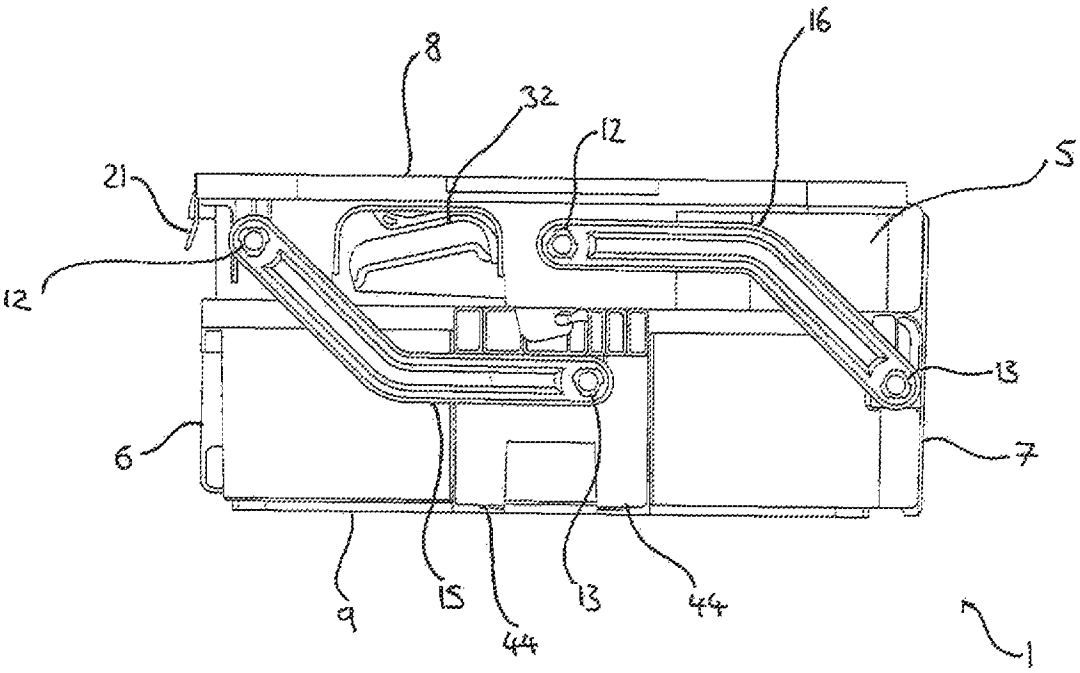
FIG. 2 is a side view of the container of FIG. 1.

FIGS. 1 and 2 show a container 1 comprising an upper section 2 and a lower section 3, each section providing at least one internal storage compartment 4. The container of FIGS. 1 to 6 comprises two opposing sides 5, a front face 6, a back face 7, a top face 8 and a bottom face 9. The container can be carried and stored in any orientation, but when in use, the bottom face will typically be placed upon a flat surface. The upper and lower sections are connected to each other by struts, and are in movable relationship to each other. A pair of struts comprising a front strut 15 and a back strut 16 is provided on both opposing side faces 5 of container. Each strut is pivotally connected to the lower section 3 at a lower connection point 13, and to the upper section 2 at an upper connection point 12.

The person skilled in the art will appreciate that other strut arrangements allowing relative movement between the upper and lower sections are possible and any such known arrangement may be applied to the container of the present invention. For example, there may be one main strut on each opposing side face of the container, and there may optionally be one or more supplementary struts to guide the relative movement.

Figure 3:
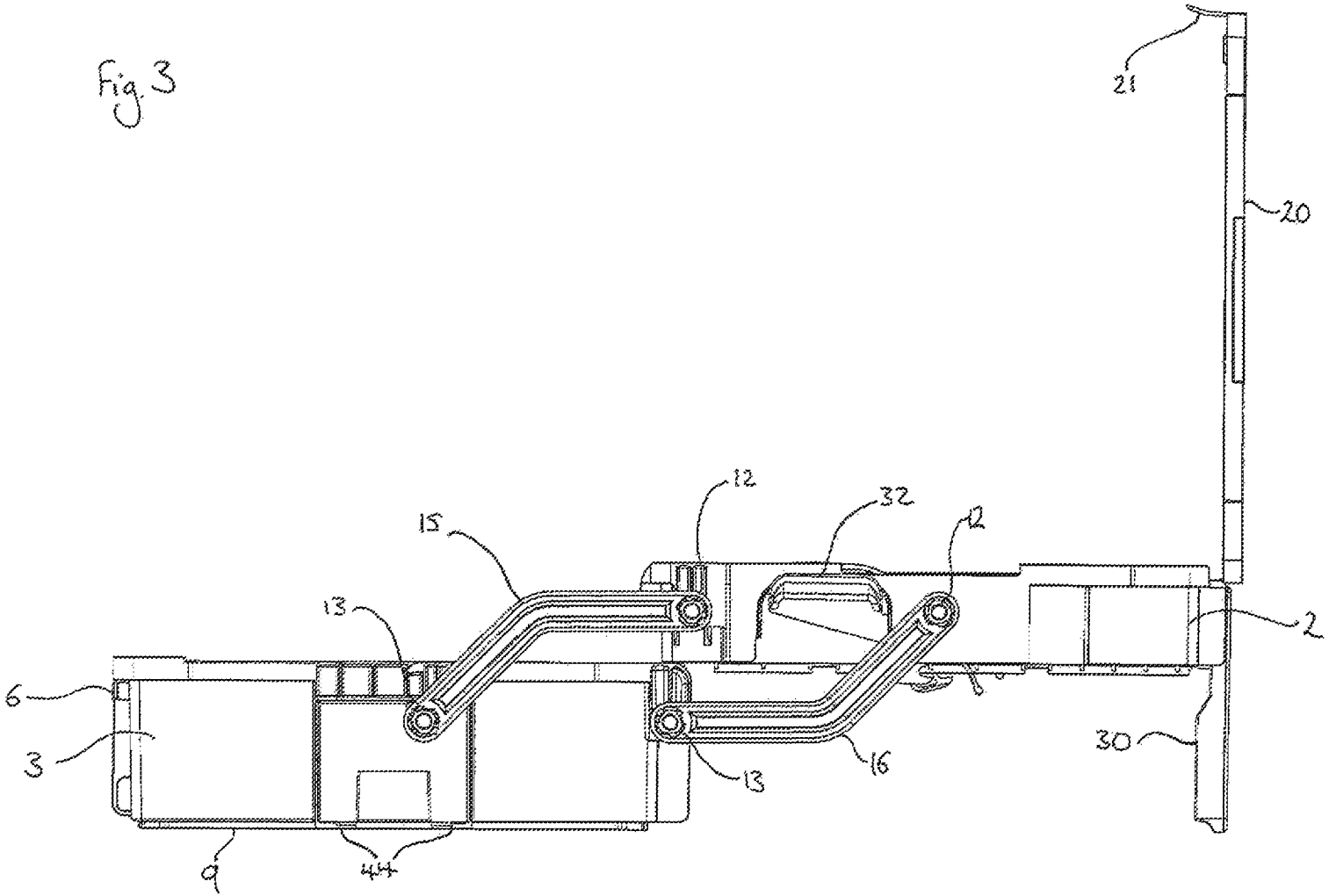
FIG. 3 is a side view of the container of FIGS. 1 and 2 in an expanded configuration.
Figure 4:
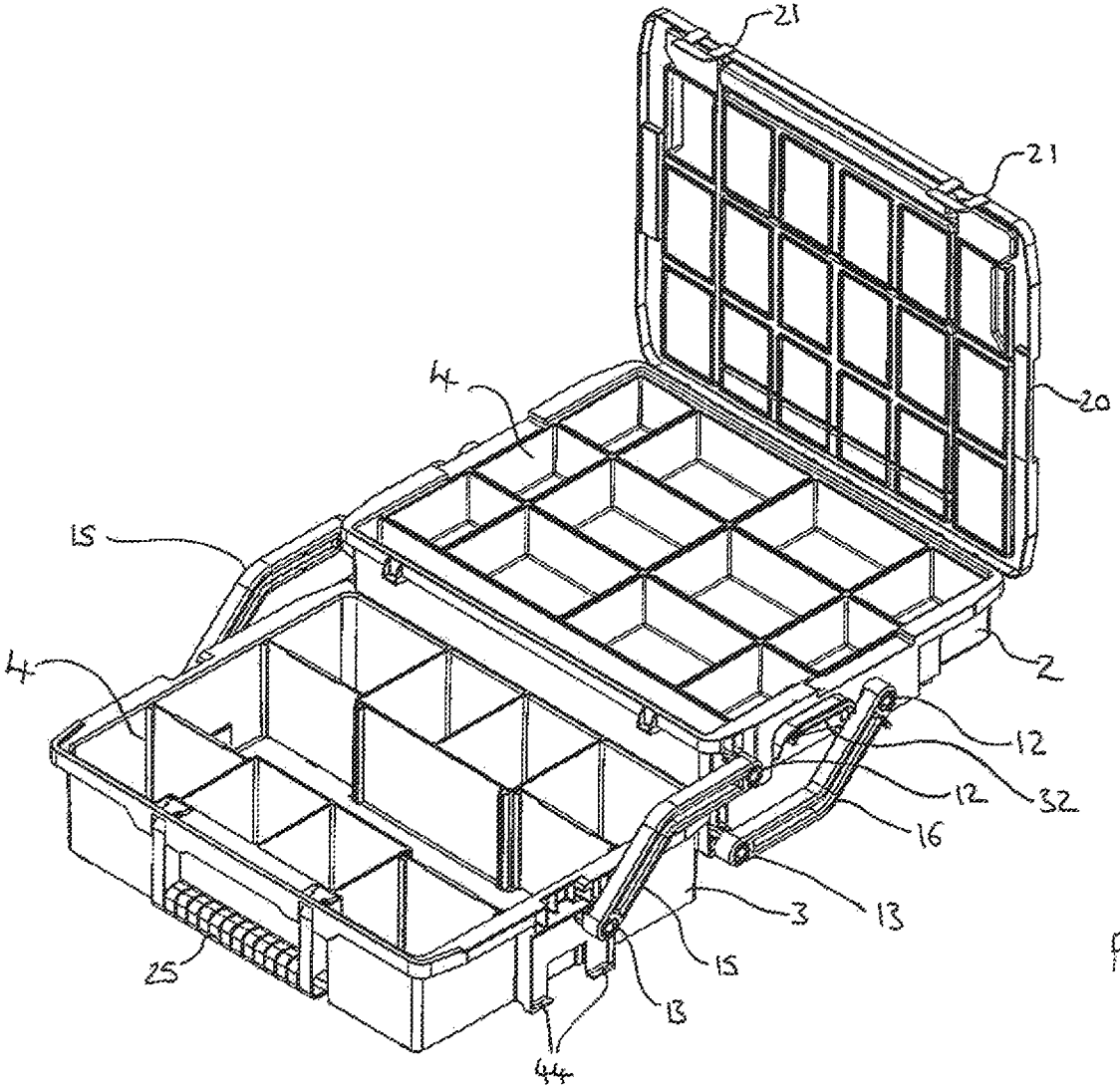
FIG. 4 is a perspective view of the container of FIG. 3.

As shown in FIGS. 3 and 4, the upper section 2 can be moved relative to the lower section 3, into an expanded configuration such that the user can access the lower section. The pivotal connections of the struts 15 and 16 to the upper and lower sections allow the upper section 2 to be swung from the closed configuration, up and across into an expanded configuration. During this movement, the upper and lower sections remain substantially parallel to each other, such that if the lower section 3 is supported on a level horizontal surface, the upper section 2 remains substantially level and horizontal during the movement into the expanded configuration.

Part or all of the top face 8 may be formed of a lid 20, which may be independently openable to allow access to the interior of upper section 2. The lid may be attached to the container at a hinge, or may be a removable lid. Lid 20 is attached to upper section 2 by a hinge located at the top edge of back face 7, and can be secured in a closed position by latches 21.

The overall utility of the container is improved by providing at least one carry handle 25. The person skilled in the art will appreciate that such a carrying handle 25 may be provided on any surface, of the container 1, for example a side face 5, the front face 6 or the top face 8 in particular, and that more than one carrying handle may be provided if desired. The handle may be fixed in relation to the container face, or it may be attached to the container by a hinge attachment, so that it can fold away when not in use.

The upper section may include one or more fixed support bars 30 as shown in FIG. 3, which can rest on a supporting surface, ideally the same surface on which the lower section 3 is placed, in order to support the weight of the upper section 2 in the expanded configuration. Such supports 30 may be either fixed in relation to the upper section 2 or may be hinged to open or fold out in various ways when the sections are in an expanded configuration.

The container comprises at least one latch 32 which retains the upper section 2 and lower section 3 in the closed configuration until the latch 32 is released, such that the container can be carried in a range of orientations while the upper and lower sections remain securely latched in the closed configuration. It is possible for such a container to be latched with one latch 32 at one side of the container. However, it is preferable to provide two similar latches 32 at opposite sides of the container, such that the user may operate one latch with their left hand and one with their right hand, simultaneously. Such an arrangement provides even, secure latching and ease of use.

Figure 5:
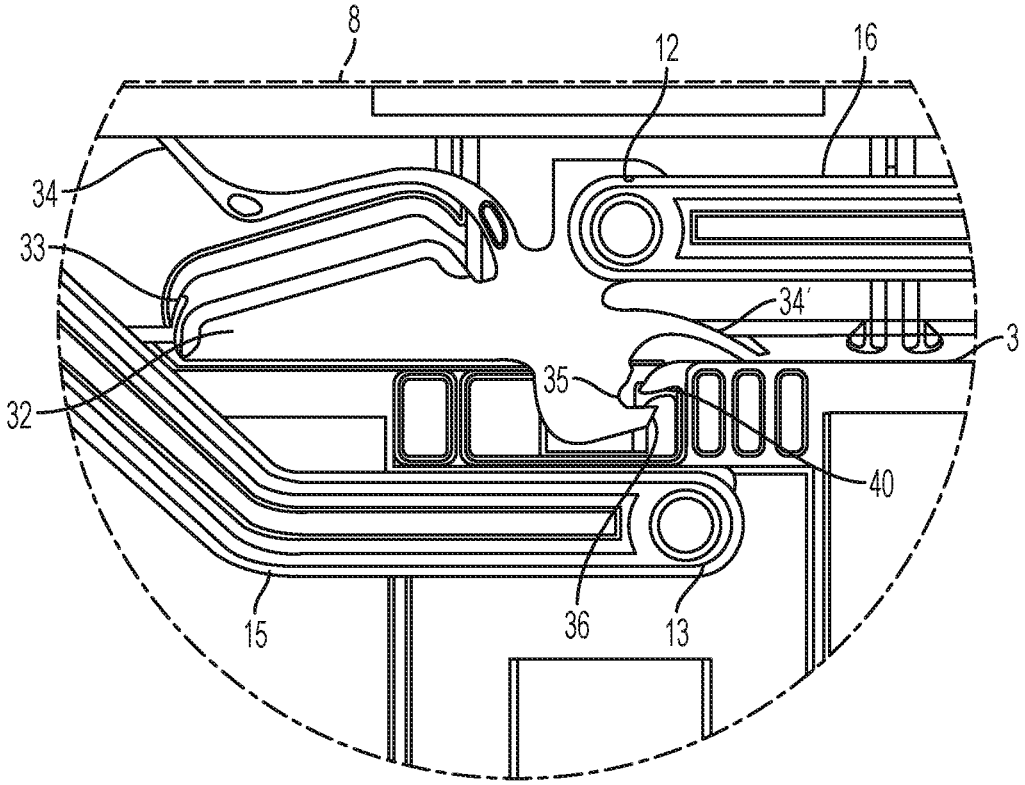
FIG. 5 is a cross-section close-up view of the container of FIG. 2, taken through the latch.
Figure 6:
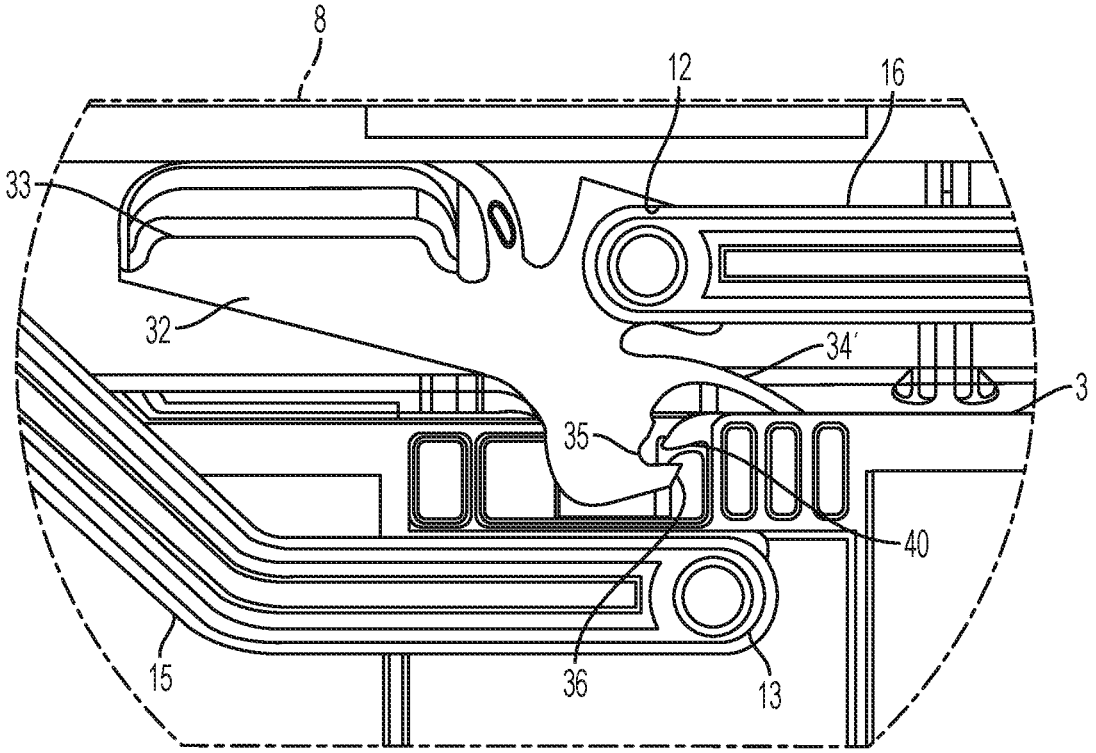
FIG. 6 is a cross-section close-up view of the container of FIG. 5, in which the latch is released from the closed position.

FIGS. 5 and 6 are partial cross-sections through the latch 32, which also show the ends of the adjacent struts, an indication of the lid and an indication of the lower section, but the upper section is not shown in position. In order to allow the upper section 2 and lower section 3 to be moved from the closed position into the expanded position, the user may operate the latch by contacting the latch grip 33 and rotating the latch grip 33 towards the top face 8 of the container 1, against a bias. The bias acts to keep the latch in the latched position until it is operated by a user. As shown in FIGS. 5 and 6, the latch 32 may rotate about a pivot point, at which it is pivotally connected to the container 1, in this example the upper section 2 of the container. The pivot point may be coaxial with connection point of a strut, here shown as the upper connection point 12 of back strut 16. Such an arrangement may simplify the construction of the container, and ensure an ergonomic opening procedure.

As shown in FIG. 5, the bias can be provided by one or more leaf springs 34, 34' in contact with the container body, but it may be provided by any other spring means or similar means known in the art. The latch 32 must be moved sufficiently to unlatch the latch hook 35 from a catch 40 on the container, which releases the upper section 2 such that it can be moved into the expanded configuration. The force required to be applied to the latch grip 33 in order to unlatch the latch 32, are similar in direction to the force required to move the upper section 2 out of the closed position, by which means the opening procedure is extremely ergonomic and simple for the user to perform.

The container may be moved from the expanded configuration into the closed configuration by reversing the opening movement of the upper section 2. The latch 32 is located such that the grip portion is naturally gripped by the user when moving the upper section from the expanded configuration into the closed configuration, such that the user grips the latch 32 against its bias during closing, and then releases the latch 32 once the upper section 2 is in the closed position, the bias spring 34 then causing the latch hook 35 to engage with the catch 40. However, if the user does not hold the upper section 2 by the latch grips 33 while closing it, but holds it at a different, point or drops it into the closed position, the latch hook 35 has a slanted surface 36 which contacts the outer surface of the catch 40 and rides over the surface as the upper section 2 approaches the closed position, until the bias spring can act to engage the latch hook 35 with the catch 40 and the container is in the latched closed position. The weight of the upper section 2 may be sufficient to overcome the bias, such that the latch automatically latches closed when the user drops it into the closed position.

Such a latch arrangement allows the user to quickly and easily move the container between the closed configuration and the expanded configuration. The upper section. 2 remains substantially parallel to the lower section 3 throughout the movement.

The arrangement is particularly advantageous if a range of tools and accessories is being carried. Items which are used most frequently and/or which are light may be stored in the upper compartment and can be accessed simply by opening the lid 20 of the upper section 2. The lid 20 may be partially or wholly transparent or translucent, so that the user can easily identify whether a particular contents is inside that section or not. Items which are used less frequently and/or which are heavier or bulkier may be stored in the lower section 3, and can be accessed when the upper section 2 is moved into the expanded configuration.

The container may comprise side flanges 44 near the bottom face 9 which may be complementary to side latches positioned near the top of another container such that the container 1 may be stacked and latched onto the top of the other container. Preferably, two sets of side flanges are provided, one set on each of the two opposing side faces 5. The container may itself have side latches complementary to the side flanges of the bottom face, such that a plurality of identical containers may be stacked and latched in a stack. Alternatively, the container may have side flanges near the top which are complementary to side latches positioned near the base of another container, such that they may be stacked and latched.

Although the examples described comprise an upper section and a lower section of a similar footprint, such that the upper section is positioned in covering relation to the lower container when they are in the closed configuration, different arrangements can be substituted. For example, the upper section may have a smaller footprint than the lower section, such that only part of the lower section can be covered by the upper section. There may be any number of additional sections attached to the container, and these sections may be open pocket-type containers, or may have independent lids or other closures. The container may be provided with one or more additional sections above the upper section, which may be linked to the upper section or to each other in movable relation in a similar way to the way in which the upper section is linked to the lower section.

The at least one internal storage compartment 4 of each section may be of any particular form. For example, one or more of the sections may be subdivided into two or more storage compartments, and such divisions between compartments may be fixed or movable. Such subdivision may be achieved in various well-known ways, including by providing movable cups, movable dividers or fixed dividers, or a combination of such means.

It should be understood that although the invention has been described in conjunction with specific embodiments thereof, it is evident that many alternatives, modifications and variations will be apparent to those skilled in the art. Accordingly, it is intended to embrace all such alternatives, modifications and variations that fall within the scope of the claims.

The invention claimed is:

1. A container comprising:

an upper section for storage, a lower section for storage, a linkage arrangement attaching the upper section to the lower section, such that the upper and lower sections are movable relative to each other between a closed configuration and an expanded configuration, wherein the linkage arrangement comprises a strut pivotally connected to the lower section at a lower pivot point and to the upper section at an upper pivot point; and a latch having a pivot point that is coaxial with either the lower pivot point or the upper pivot point of the strut, and being configured to be pivotable between a closed position and a released position, wherein the latch retains the upper section and the lower section in the closed configuration when the latch is in the closed position, and allows the upper section and the lower section to move to the expanded configuration when the latch is in the released position.

2. The container according to claim 1, wherein the latch is biased to retain the upper section and the lower section in the closed configuration and wherein moving the latch against its bias allows the upper and lower section to be moved into the expanded configuration.

3. The container according to claim 2, wherein the latch is movable from the closed position into the released position by applying force in substantially the same direction as that required to move the upper and lower sections from the closed configuration into the expanded configuration.

4. The container according to claim 1, wherein the upper section has a removable lid.

5. The container according to claim 1, wherein the upper section has a hinged lid.

6. The container according to claim 1, wherein at least one of the upper section and the lower section are divided into sub-compartments.

* * * * *